United States Patent [19]

Law

[11] 4,378,962

[45] Apr. 5, 1983

[54] LIQUID FUEL INJECTION PUMPING APPARATUS

[75] Inventor: David J. C. Law, London, England

[73] Assignee: Lucas Industries Limited, Birmingham, United Kingdom

[21] Appl. No.: 274,191

[22] Filed: Jun. 16, 1981

[30] Foreign Application Priority Data

Jul. 18, 1980 [GB] United Kingdom ..... 8023516

[51] Int. Cl.[3] ..... F04B 19/22; F04B 29/00

[52] U.S. Cl. ..... 417/462; 417/488; 417/486

[58] Field of Search ..... 91/491; 92/69 R, 129, 92/165 PR, 172; 417/460, 462, 487, 488

[56] References Cited

U.S. PATENT DOCUMENTS

| | | | |
|---|---|---|---|
| 3,771,506 | 11/1973 | Davis | 417/218 |
| 4,118,155 | 10/1978 | Mowbray | 417/221 |
| 4,299,542 | 11/1981 | Potter | 417/462 |

*Primary Examiner*—William L. Freeh
*Assistant Examiner*—Jane E. Obee

[57] ABSTRACT

A liquid fuel injection pumping apparatus has a rotary distributor member in which is formed at least two bores which intersect and contain plungers. The plungers are moved inwardly by a cam and their ends are shaped to fit together so as to reduce the volume of fuel at their maximum extent. In order to maintain the alignment of the plungers each is provided with a slot which receives a disc-like member to maintain the relative alignment of the plungers throughout their stroke.

4 Claims, 3 Drawing Figures

LIQUID FUEL INJECTION PUMPING APPARATUS

This invention relates to liquid fuel injection pumping apparatus for supplying fuel to an internal combustion engine, and of the kind comprising a rotary distributor member rotatably mounted within a body part and arranged in use to be driven in timed relationship with an associated engine, at least two radial bores formed in the distributor member, said bores being disposed in the same radial plane and meeting each other at their inner ends and having their axes angularly off-set, a passage communicating with the inner ends of the bores, plungers in said bores respectively, port means defined by the distributor member and body part and through which fuel can flow to said bores through said passage to effect outward movement of the plungers, a cam ring surrounding said distributor member and having cam lobes formed thereon which during rotation of the distributor member impart simultaneous inward movement to said plungers and further port means defined by the distributor member and body part through which fuel displaced from said bores, as the plungers are moved inwardly, can flow to the associated engine.

Such apparatus is well known in the art and it is known that the residual volume of fuel in the bores and passages in the distributor member at the end of the inward movement of the plungers should be kept as low as possible to reduce the hydraulic flexibility. One way of achieving this object in the case where four bores are provided, is to arrange that two plungers in opposing bores are of increased axial length as compared with those in the other bores. The effect of this is that the longer plungers when they are moved inwardly to their maximum extent, occupy substantially the whole of the volume at the inner ends of the bores and the shorter plungers move adjacent to but do not touch the other plungers. This arrangement means that two of the plungers have a shorter axial length and this can cause problems with leakage and there is still a large hydraulic volume in the distributor member.

The object of the present invention is to provide an apparatus of the kind specified in a simple and convenient form.

According to the invention in an apparatus of the kind specified the inner ends of the plungers are shaped so that when the plungers have moved inwardly their maximum extent, substantially the whole of the space of the inner ends of the bores will be occupied by the plungers, each plunger having an axial slot defined therein which extends from the inner end of the plunger, the apparatus including a plate like member located in the slots in the plungers respectively and acting to retain the plungers against angular movement within the bores.

An example of an apparatus in accordance with the invention will now be described with reference to the accompanying drawings in which.

Figure 1:
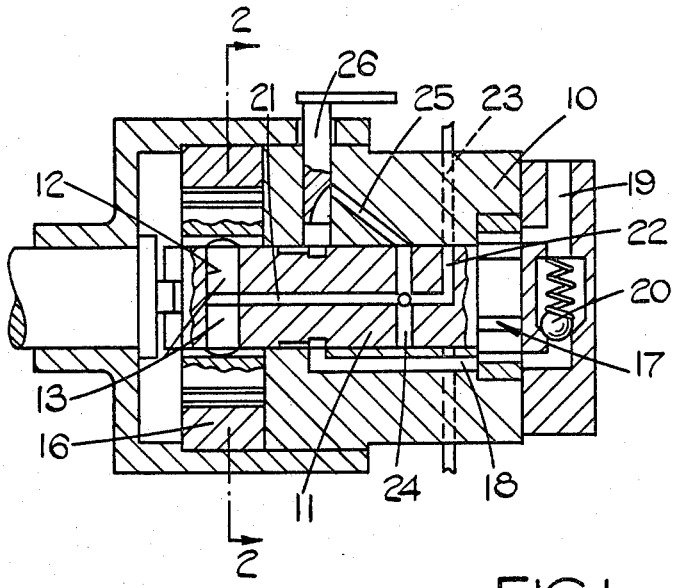
FIG. 1 is a sectional side elevation of an apparatus.

The apparatus comprises a body part 10 defining a bore in which is journalled a rotary cylindrical distributor member 11. A part of the distributor member extends from the bore and is coupled to an input shaft so that it rotates in timed relationship with the associated engine.

In the particular example there is formed four radially extending bores 12 the bores lying in a common radial plane and intersecting at their inner ends. Located within the bores are plungers 13 respectively, the outer ends of which are engaged by shoes respectively each carrying rollers for engagement with the internal peripheral surface of an annular cam ring 16 which surrounds the distributor member at this point. The cam ring is provided with inwardly extending cam lobes which as the distributor member rotates, engage with the rollers to impart simultaneous inward movement to the plungers 13.

The space defined at the inner ends of the bores communicates with a longitudinal passage 21 extending within the distributor member and this passage at one point communicates with an outwardly extending delivery passage 22 arranged to register in turn and during successive inward movements of the plungers, with outlet ports 23 formed in the body part. The outlet ports in use are connected to the injection nozzles of an associated engine.

At another position the longitudinal passage 21 communicates with the inlet passages 24 and these communicate in turn with an inlet port 25 or ports formed in the body part and communicating by way of a throttle 26, with the oulet 18 of a low pressure fuel supply pump 17. When an inlet passage registers with the inlet port fuel flows to the inner ends of the bores 12 to effect outward movement of the plungers, the quantity of fuel being determined by the setting of the throttle. When the plungers are moved inwardly, the displaced fuel flows through an outlet 23 to the associated engine. The pump 17 has a fuel inlet 19 and the inlet and outlet are connected by a relief valve 20 which controls the outlet pressure thereof.

It is desirable that the volume of fuel remaining at the inner ends of the bores 12 and in the passages 21, 22 and 24 in the distributor member should be as low as possible at the end of the delivery stroke. It is of course difficult to reduce the volume of the passages in the distributor member without impairing the flow of fuel, but in order to reduce the volume of fuel at the inner ends of the bores, the plungers 13 are provided with wedge shaped end portions 27 capable of interfitting together so as to reduce the volume of the space. It is not however desirable that the plungers should interfit exactly since this could impair the filling of the bores with fuel. In the case where there are four bores equiangularly spaced about the distributor member, the wedge shaped end portions 27 will have an angle of approximately 90°. If there are three bores again equiangularly spaced, the wedge shaped end portions will have an angle of approximately 120°. In the example shown the bores are not equiangularly spaced and so the angle of each face relative to the axis of the plunger is different but the two faces of each plunger will be disposed at 90°.

Figure 2:
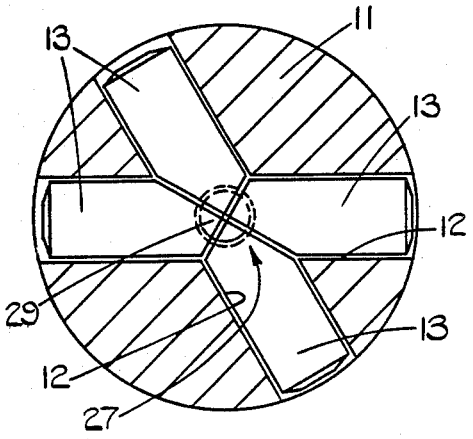
FIG. 2 is a section through the distributor member of the apparatus.
Figure 3:
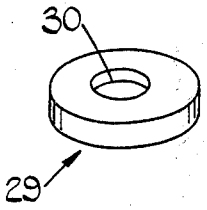
FIG. 3 is a perspective view of a pumping plunger showing the inner end thereof.
Figure 3:
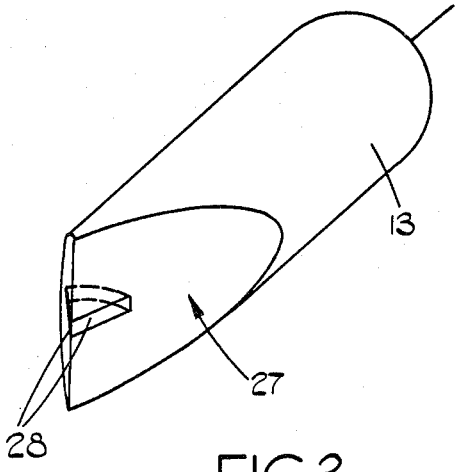

It is necessary with such an arrangement, to prevent angular movement of the plungers otherwise there is a risk of collision between plungers as these are moved inwardly. Such collision would have a damaging effect and in order to minimise the risk of this occuring, each plunger at its inner end is provided with a slot 28. The slot is formed in the wedge portion and located in the slots is a plate-like member which is shown in dotted outline at 29 in FIG. 2 and in perspective in FIG. 3. The plate-like member 29 is of circular form and engages within all the slots and thereby prevents angular movement of the plungers whilst of course allowing the plungers to move outwardly. The plate-like member and slots are of such a size that the member remains with the slots even when the plungers have moved outwardly their maximum extent.

The member 29 can act as a stop to limit the inward movement of the plungers due for example to inertia and it has a central aperture 30 to facilitate the filling of the bores. Preferable the wedge shaped end portions 27 have an angle slightly greater than that necessary for perfect interfitting to create a small space at the ends of the plungers.

I claim:

1. A liquid fuel injection pumping apparatus for supplying fuel to an internal combustion engine comprising a rotary distributor member rotatably mounted within a body part and arranged in use to be driven in timed relationship with an associated engine, at least two radial bores formed in the distributor member, said bores being disposed in the same radial plane and meeting each other at their inner ends and having their axes angularly off-set, a passage communicating with the inner ends of the bores, plungers in said bores respectively, port means defined by the distributor member and body part and through which fuel can flow to said bores through said passage to effect outward movement of the plungers, a cam ring surrounding said distributor member and having cam lobes formed thereon which during rotation of the distributor member impart simultaneous inward movement to said plungers, further port means defined by the distributor member and body part through which fuel displaced from said bores, as the plungers are moved inwardly, can flow to the associated engine, the inner ends of the plungers being shaped so that when the plungers have moved inwardly their maximum extent, substantially the whole of the space of the inner ends of the bores will be occupied by the plungers, each plunger having an axial slot defined therein which extends from the inner end of the plunger, the apparatus including a plate-like member located in the slots in the plungers respectively and acting to retain the plungers against angular movement within the bores.

2. An apparatus according to claim 1 in which the inner end portions of said plungers are wedge shaped.

3. An apparatus according to claim 1 or 2 in which said plate-like member is provided with a central aperture.

4. An apparatus according to claim 2 in which the shaped end portions of said plungers have an angle slightly greater than that necessary for perfect interfitting.

* * * * *